US010426698B2

(12) United States Patent
Rodriguez

(10) Patent No.: US 10,426,698 B2
(45) Date of Patent: Oct. 1, 2019

(54) PILL CONTAINER WITH CAP

(71) Applicant: Breeden Brothers, LLC, Nashville, TN (US)

(72) Inventor: Jack Rodriguez, Bernardsville, NJ (US)

(73) Assignee: Breeden Brothers, LLC, Nashville, TN (US)

( * ) Notice: Subject to any disclaimer, the term of this patent is extended or adjusted under 35 U.S.C. 154(b) by 0 days.

(21) Appl. No.: 15/372,982

(22) Filed: Dec. 8, 2016

(65) Prior Publication Data

US 2018/0161242 A1 Jun. 14, 2018

(51) Int. Cl.

| | |
|---|---|
| ***A61J 1/03*** | (2006.01) |
| ***B65D 25/54*** | (2006.01) |
| ***B65D 25/40*** | (2006.01) |
| ***B65D 41/04*** | (2006.01) |
| ***B65D 43/16*** | (2006.01) |
| ***B65D 83/04*** | (2006.01) |

(52) U.S. Cl.

CPC ..... *A61J 1/03* (2013.01); *B65D 25/40* (2013.01); *B65D 25/54* (2013.01); *B65D 41/0471* (2013.01); *B65D 43/16* (2013.01); *B65D 83/04* (2013.01)

(58) Field of Classification Search

CPC .... B65D 25/40; B65D 25/54; B65D 41/0471; B65D 43/16; B65D 83/04; B65D 83/0409; B65D 83/0427; A61J 1/03

See application file for complete search history.

(56) References Cited

U.S. PATENT DOCUMENTS

| | | | | |
|---|---|---|---|---|
| 2,943,730 A * | 7/1960 | Tregilgas | B65D 83/0454 116/308 |
| 3,289,885 A * | 12/1966 | Villaveces | B65D 47/265 215/380 |
| 3,383,013 A * | 5/1968 | Szekely | B65D 83/049 221/202 |
| 3,638,830 A * | 2/1972 | Belokin, Jr. | B65D 83/0409 206/533 |
| 3,782,584 A * | 1/1974 | Swenson | B65D 43/12 206/232 |
| 5,035,237 A * | 7/1991 | Newell | A61M 15/0045 128/203.15 |
| 5,636,756 A | 6/1997 | Johnson | |
| 5,725,114 A | 3/1998 | Pickman | |
| 5,752,604 A | 5/1998 | Hayman | |
| 5,782,359 A | 7/1998 | McAllister et al. | |
| 5,887,736 A | 3/1999 | Mar | |

(Continued)

OTHER PUBLICATIONS

"Aleve PM Caplets", http://www.cvs.com/shop/health-medicine/pain-fever/sleeplessness/aleve-pm-caplets-prodid-1012319.

*Primary Examiner* — David P Angwin
*Assistant Examiner* — Bob Zadeh
(74) *Attorney, Agent, or Firm* — Behmke Innovation Group LLC; James Behmke; Stephen D. LeBarron

(57) ABSTRACT

A pill container and cap for storing and dispensing medication is described. In various embodiments, the pill container comprises an outer shell having an angled corner section, a constriction within the outer shell configured to limit flow of the medication out of the container a cap to seal the container. Various additional features and component are also described.

18 Claims, 8 Drawing Sheets

(56) References Cited

U.S. PATENT DOCUMENTS 5,931,302 A * 8/1999 Isaacs ..... B65D 83/0409 206/538
6,068,126 A * 5/2000 DeJonge ..... B65D 83/0409 206/528
6,112,920 A 9/2000 Lahaussois
6,707,763 B2 3/2004 Osberg et al.
6,772,902 B1 8/2004 White
6,880,722 B2 * 4/2005 Anderson ..... A61M 15/0045 206/531
7,073,685 B1 * 7/2006 Giraud ..... B65D 83/0409 221/260
7,111,746 B2 9/2006 Miceli et al.
7,249,687 B2 * 7/2007 Anderson ..... A61M 15/0045 128/203.15
7,339,457 B2 3/2008 Trochesset
7,495,546 B2 * 2/2009 Lintell ..... A61J 7/0481 128/200.14
D607,316 S * 1/2010 Verebelyi ..... D27/189
7,743,923 B2 * 6/2010 Conley ..... A61J 7/0472 206/534.1
7,988,016 B2 * 8/2011 Klein ..... B65D 83/0409 221/1
8,091,733 B2 * 1/2012 Janet ..... A61J 7/02 211/195
8,167,156 B2 5/2012 Milante
8,434,476 B2 * 5/2013 Von Schuckmann ..... A61M 15/0045 128/200.24
8,446,799 B2 5/2013 Burke, Jr. et al.
8,657,155 B2 * 2/2014 Dwork ..... B65D 83/0481 221/229
8,746,242 B2 * 6/2014 Connell ..... A61M 15/0045 128/203.21
8,875,915 B2 11/2014 Serell
8,938,999 B2 1/2015 Dahl
9,027,787 B2 * 5/2015 Eriksson ..... A61J 7/0481 221/83
9,056,174 B2 * 6/2015 Bradshaw ..... A61M 15/0045
9,463,290 B2 * 10/2016 Thoemmes ..... A61M 15/00
2004/0035420 A1 * 2/2004 Davies ..... A61M 15/0028 128/203.15
2005/0247306 A1 * 11/2005 Harvey ..... A61J 7/0472 128/200.21
2010/0083962 A1 * 4/2010 Von Schuckmann ..... A61M 15/0045 128/203.15
2013/0180983 A1 * 7/2013 Krstic ..... B65D 1/0223 220/23.83
2014/0326239 A1 * 11/2014 Davies ..... A61M 15/0045 128/203.15
2015/0048101 A1 * 2/2015 Reddy ..... A61J 7/0076 221/1
2016/0090233 A1 * 3/2016 Schiffmiller ..... B65D 85/70 206/528
2018/0012439 A1 * 1/2018 King ..... A61J 7/0076
2018/0161242 A1 * 6/2018 Rodriguez ..... A61J 1/03

* cited by examiner

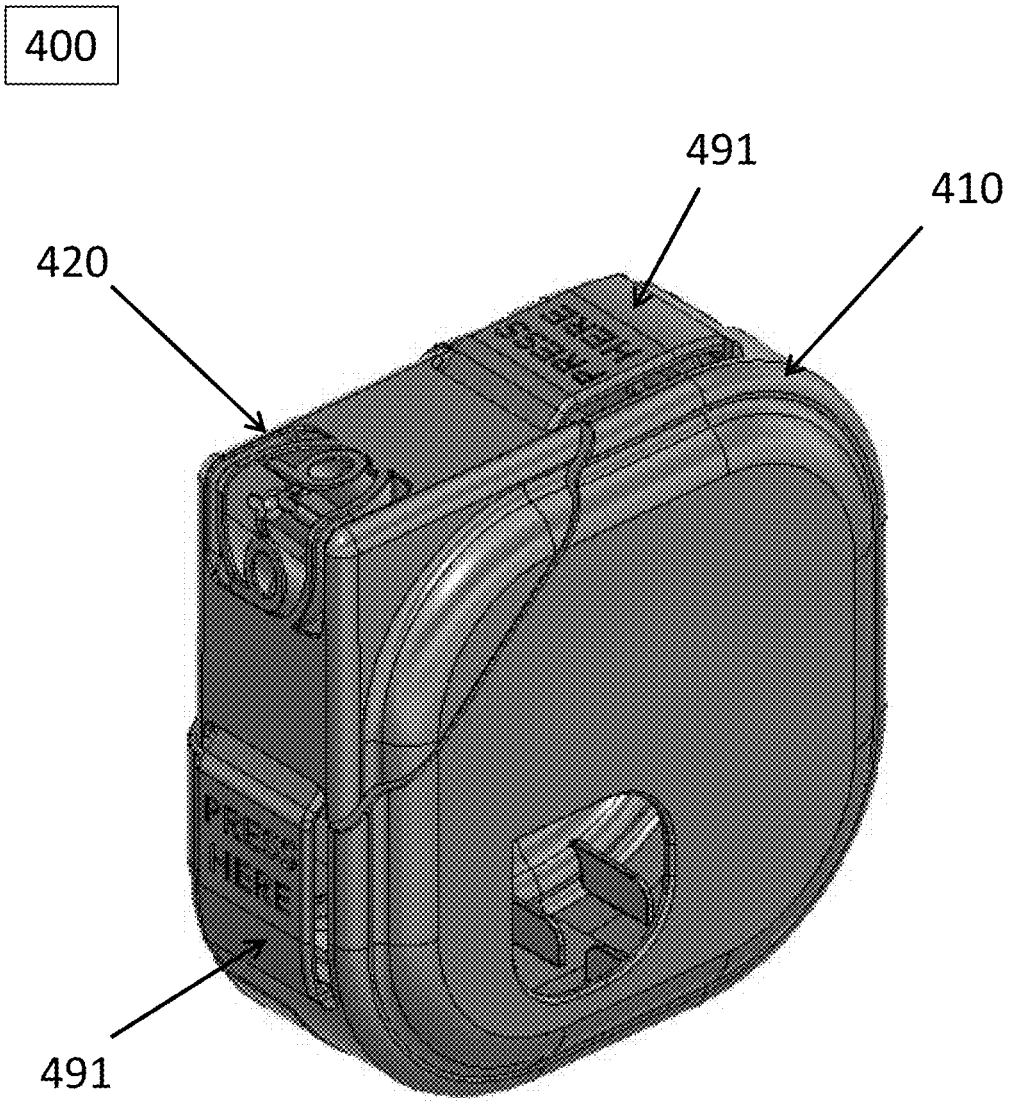
FIB 4A

PILL CONTAINER WITH CAP

TECHNICAL FIELD

The present disclosure relates generally to containers for storing and dispensing medication and, more particularly, to a container with a twistable corner cap for dispensing medication in pill form.

BACKGROUND

Various types of containers are available for storing and dispensing medications, and they are often designed for a specific type or form of medication. For example, bottles having wide spouts are generally preferred for dispensing liquid medications, particularly thicker fluids. In addition, a variety of different types of containers, such as various packages, cases, and bottles are available for pills, with the size and dimensions tailored to the type of and shape of the pill. Typically, these bottles are provided in additional packaging, such as a resealable cardboard box.

SUMMARY

The present disclosure relates to a container for storing and dispensing medication, particularly in pill form. In one embodiment, the pill container comprises an outer shell having a flat bottom section and an angled corner section, which has an opening for dispensing pills. The pill container further comprises a constriction within the outer shell configured to restrict flow of pills out from the pill container and a cap to seal the opening. In a specific embodiment, the outer shell comprises a first shell section removably coupled to a second shell section. In addition, the pill container may, in some embodiments, comprise a bottle sized and shaped to fit within the outer shell and configured to contain pills.

It is to be understood that the foregoing general description and the following detailed description are exemplary and explanatory only and are intended to provide further explanation of the present disclosure as claimed.

BRIEF DESCRIPTION OF THE DRAWINGS

The foregoing and other objects, features, aspects, and advantages of the embodiments disclosed herein will become more apparent from the following detailed description when taken in conjunction with the following accompanying drawings.

FIGS. 4A-4D are perspective views of a specific embodiment of the present disclosure, comprising mated interlocks.

Figure 1A:
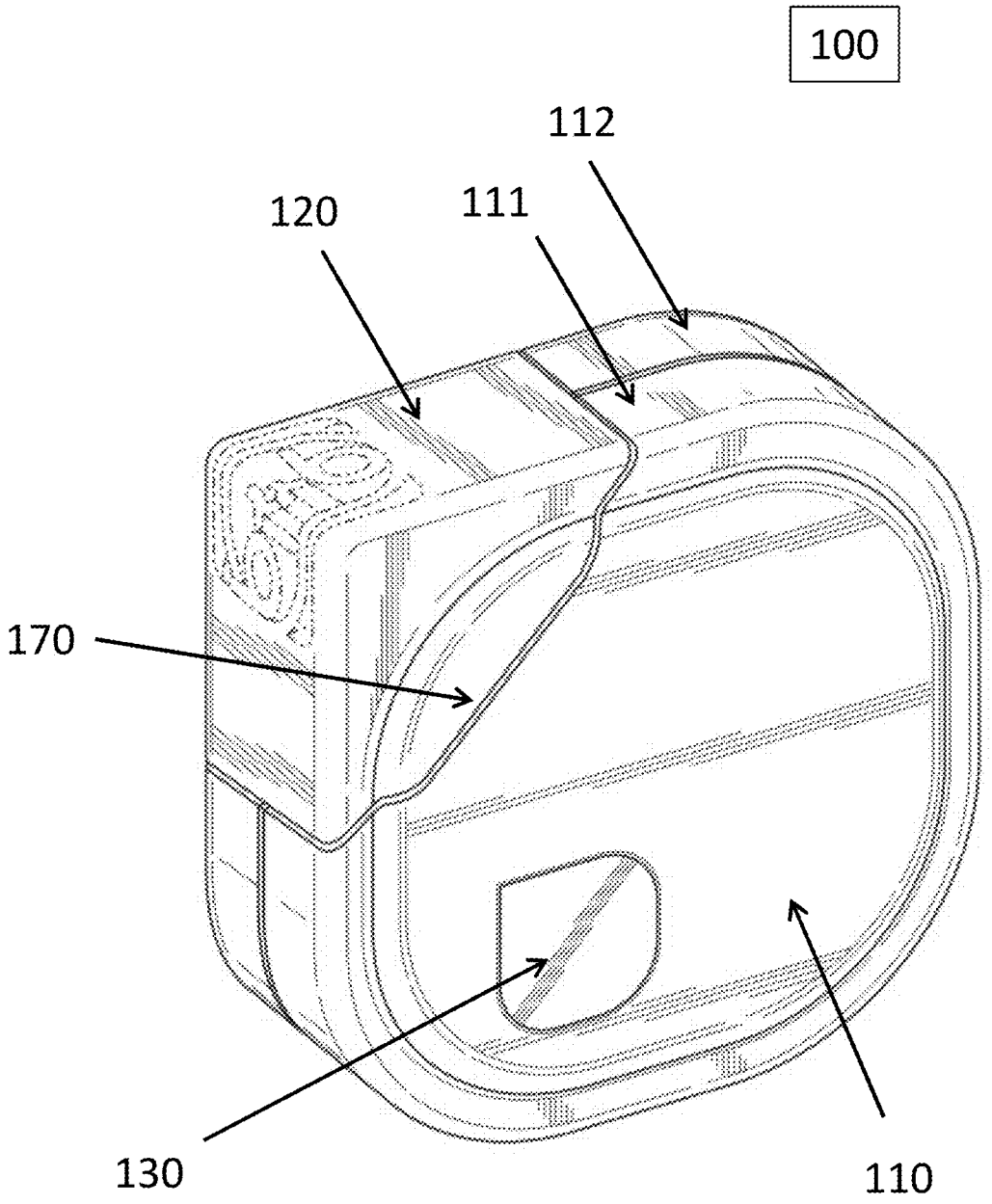
FIGS. 1A-1D are views of a pill container according to various embodiments of the present disclosure.

It should be understood that the above-referenced drawings are not necessarily to scale, presenting a somewhat simplified representation of various preferred features illustrative of the basic principle of the disclosure. The specific design features of the present disclosure, including, for example, specific dimensions, orientations, locations, and shapes, will be determined in part by the particular intended application and use environment.

DESCRIPTION OF EXAMPLE EMBODIMENTS

The present disclosure describes a pill container that is portable and can store and dispense pills as needed.

The pill container of the present disclosure comprises an outer shell in which pills can be stored. In one embodiment, the outer shell is a shell assembly comprising more than one shell section coupled together. In this way, the shell sections may be attached to each other and later detached, such as to fill or refill the container. For example, the outer shell may comprise at least a first shell section detachably coupled to a second shell section. In particular, the outer shell may comprise two shell halves coupled together. In some embodiments, while detachable, the shell sections are designed to be difficult to separate, such as to prevent the consumer from having access to the contents within the shells. Any known means or techniques for coupling and detaching the shell sections to form the shell assembly may be used, including various clasps, clips, or snaps. Furthermore, the shell sections may be completely separable or may be hinged together, forming a hinged shell assembly when opened.

The outer shell can vary in size and shape, depending, for example, on the targeted use. In some embodiments, the outer shell has a flat bottom section, enabling the pill container to stand upright. The bottom section may further comprise raised ridges or feet to provide better stability. In a specific embodiment, the outer shell comprises a flat bottom section to stand upright and a substantially square cross-sectional shape in a direction perpendicular to the flat bottom section. The square shape may be partially truncated due to the angled corner section, described below. Other cross-sectional shapes are also possible, including but not limited to, rectangular, triangular, hexagonal, rhomboid, etc. Preferably, the outer shell is sized and shaped to fit comfortably in the palm of a user's hand. In addition, in some embodiments, the front and back surfaces are smooth and flat, and may further comprise printed information (such as brand name, medication type, dosage, etc.). In this way, there is no need to additionally provide an outer box or other packaging into which the pill container of the present disclosure would be placed, which is a desirable feature for sustainability.

In some embodiments, the outer shell comprises an angled corner section having an opening through which pills, contained therein, may be dispensed. The angle of the corner section can vary, depending, for example, on the cross-sectional shape of the outer shell and on the desired pour angle of the pills from the container. For example, the angle can be from 10° to about 80°, including from about 30° to about 60°, and, in particular, may be about 45°. The angle may be in a single direction (such as horizontal) relative to a surface of the outer shell or may be a compound angle. The corner section may be flat (having no curvature) or may be curved horizontally and/or vertically. In a specific embodiment, the outer shell comprises parallel horizontal top and bottom surfaces, and the corner section forms a substantially 45° angle with the top surface.

The opening in the corner section is configured to enable the pills within the container to be dispensed and can vary in size and shape depending, for example, on the type of pills. For example, if the pill is a capsule, a larger and wider opening may be preferred, with an oval or rectangular shape while for smaller pills that are relatively flat with a round cross-sectional shape (e.g., disc-shaped), a smaller opening having a round/circular or square opening may be preferred. The opening, in some embodiments, may also be configured to enable filling the container with pills, using various convention filling machines and/or techniques In some embodiments, the pill container further comprises a bottle housed within the outer shell. As such, the bottle is separate from the shell, and can, for example, be filled with medication as needed. For example, the bottle may be positioned within the shell and filled or, alternatively, may be filled separately and later fit inside and enclosed within the shell. The bottle may comprise a spout through which the pills can be dispensed. The spout is configured to protrude through and extend out from the opening in the outer shell and may be threaded as desired for easy sealing.

The bottle, in some embodiments, is transparent, allowing the user to view the contents of the bottle to determine, for example, the number of pills remaining. In particular, the outer shell, such as one or more of the shell sections, may include an opening enabling the user to view the medication contained within. The window may contain a transparent window preventing direct contact with the container contents, or the window may be open, particularly with a bottle within the shell. The position and size of the window can vary depending, for example, on the size and shape of the bottle, which, in some embodiments, is similar to the size and shape of the outer shell. The bottle may further comprise cut out or formed sections to ensure the contents are always visible through the window. Thus, the bottle may have a volume and shape that is considerably different from the outer shell, lacking portions not visible in the window, but still configured to fit within the shell. For example, the outer shell may have an overall square cross-sectional shape, with the window positioned at the lower left quadrant, and the bottle may have a truncated square shape, with the lower right quadrant removed as it is not visible through the window. This is particularly useful for small pills that would not be readily seen as the bottle becomes less full.

In some embodiments, the pill container comprises at least one constriction within the outer shell that is configured to reduce the flow of pills out of the container. As such, the constriction forms a region or zone of reduced volume within the outer shell. For example, the constriction may be formed by the walls of the bottle or by protruding walls within the shell, which may gradually slant of taper inwardly towards the spout or opening, forming a funnel shape which can reduce or otherwise limit the flow of pills from the container. As another example, a portion of the wall of the bottle or the outer shell may be slanted or curved to provide the constriction. In this way, the number of pills dispensed at one time may be minimized, which is desirable especially for small pills which tend to pour rapidly out of container.

In some embodiments, the pill container comprises at least one cap configured to seal the container in order to retain pills within. As such, the cap is positioned to seal the opening of the outer shell. In particular, the cap may be positioned on the angled corner section of the outer shell. A variety of different types of caps may be used, depending on the configuration of the opening. For example, the cap may be twistable, turnable, or may snap in position. In a specific embodiment, the pill container comprises a bottle, described above, having a spout protruding through the opening, and the cap is positioned on the spout to seal the contents therein. For example, the spout may be threaded, and the cap may have threads corresponding to or otherwise mating with the threads on the spout. Multiple caps may also be used, such as a threaded cap to seal the spout of the bottle and a covering cap to provide shape to the overall pill bottle.

The shape of the cap of the pill container can also vary, depending, in particular, on the shape of the outer shell. In an embodiment in which the cap is positioned on the angled corner section of the outer shell, the cap may complete the overall shape of the outer shell. For example, with the cap in place, the pill container may have a square horizontal cross-sectional shape, as described above, with the cap filling in the truncated section of the square. As such, the cap, in this embodiment, has a triangular cross-sectional shape.

In one embodiment, the cap and spout comprise features that cause the cap to securely seal the spout, such as a locking or sealing feature. For example, the spout may be threaded and further comprise a raised section on the thread over which a feature of the correspondingly threaded cap must pass and become engaged when the cap is turned. To open, the cap would meet some resistance when counter-turned since the cap feature would have to disengage from and pass over the raised section of the spout thread again. In a specific embodiment, the threaded spout comprises a raised insert, and the cap comprises a raised section having a notch or valley, wherein the notch is configured to pass over raised insert of the spout, and the raised insert is configured to rest within the notch or valley as the cap is turned. Engagement of the cap feature and the spout feature provides a more secure seal of the container, preventing or at least providing resistance against, opening.

In a specific embodiment, the pill container further comprises child proof or child resistant features. In particular, the cap and outer shell may comprise mated interlock configured to prevent the cap from turning. Releasing the interlock would allow the cap to turn and the pill container to be opened. For example, the cap may comprise at least one raised blocking tab and the outer shell may comprise at least one locking tab or button that can engage the blocking tab of the cap. When released, such by depressing the locking tab inwardly, the blocking tab is no longer engaged and the cap may turn. The locking tab on the shell may further comprise an extender to more readily engage the blocking tab. Multiple locking tabs and blocking tabs may be used. For example, the outer shell may comprise a pair of inwardly depressible locking tabs positioned on opposing sides of the cap and opening and the cap may further comprise a pair of blocking tabs correspondingly positioned on opposing sides of the cap. Additional child resistant or child proof features may also be provided, for additional safety. For example, the cap may further comprise at least one gap, such as on opposing sides of the cap. The locking tabs of the outer shell may engage these gaps, preventing the cap from turning until the locking tabs are inwardly depressed.

Specific embodiments and components of the pill container of the present disclosure are shown in FIGS. 1-4 and discussed below. However, it should be apparent to those skilled in the art that these are merely illustrative in nature and not limiting, being presented by way of example only. Numerous modifications and other embodiments are within the scope of ordinary skill in the art and are contemplated as falling within the scope of the present disclosure. In addition, those skilled in the art should appreciate that the specific configurations are exemplary and that actual configurations will depend on the specific system. Those skilled in the art will also be able to recognize and identify equivalents to the specific elements shown, using no more than routine experimentation.

Figure 1B:
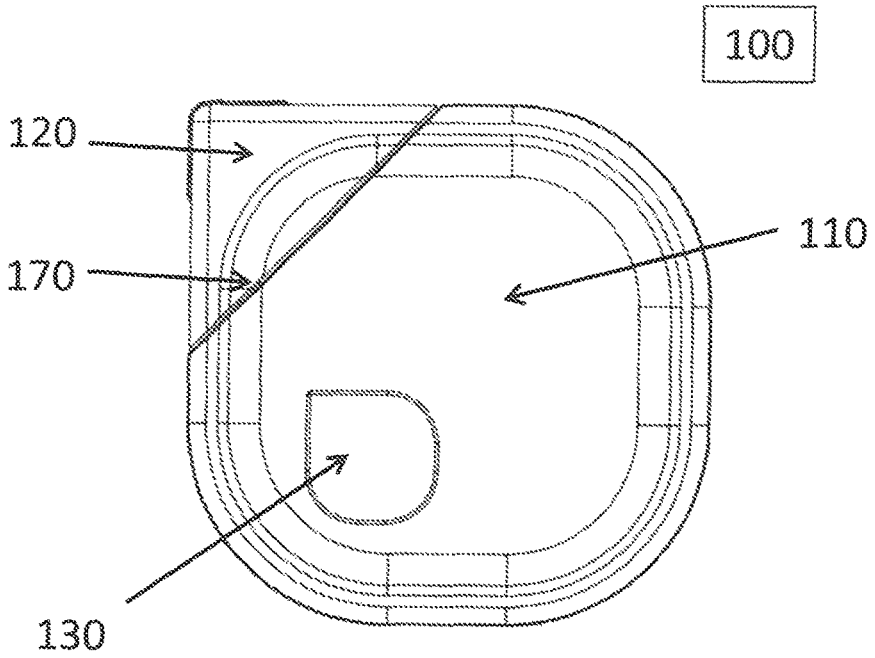
Figure 1C:
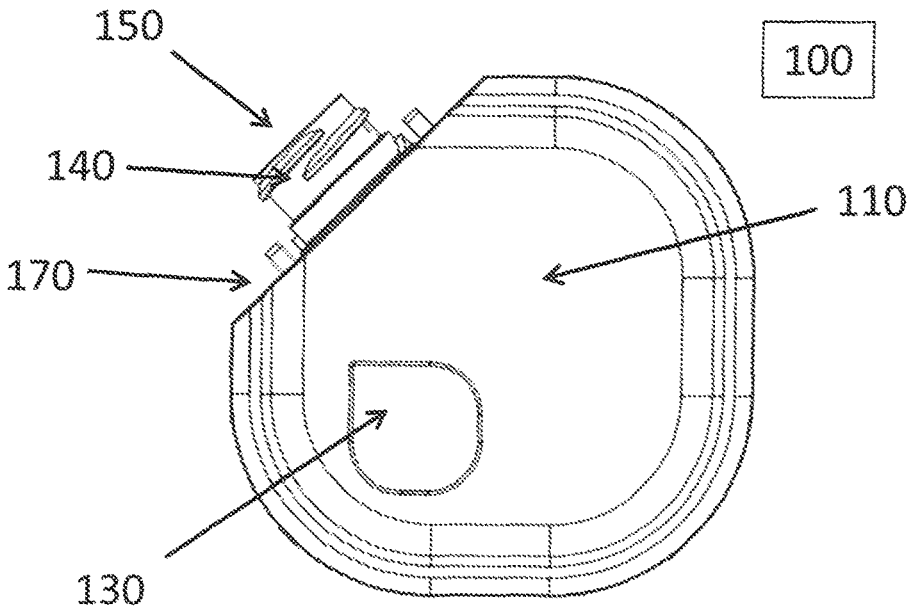

An embodiment of the pill container of the present disclosure is shown in FIGS. 1A-1D. FIG. 1A is a perspective view of pill container 100, which comprises outer shell 110 and cap 120. As shown, the outer shell includes front shell 111 and back shell 112, which, in this specific embodiment, are separate components that snap together to form the outer shell. In some embodiments, the two shell sections are joined by a hinge. Front shell 111 further comprises window 130 through which the contents of the container can be viewed. FIG. 1B and FIG. 1C provide front views of pill container 100. In FIG. 1C, cap 120 is removed, more clearly showing angled corner section 170 through which spout 140 of bottle 150 protrudes. The cap seals the spout of the bottle, fitting along the angled corner section. As also shown in these figures, outer shell 110 further includes window 130 which provides visibility to the contents of pill container 100.

Figure 1D:
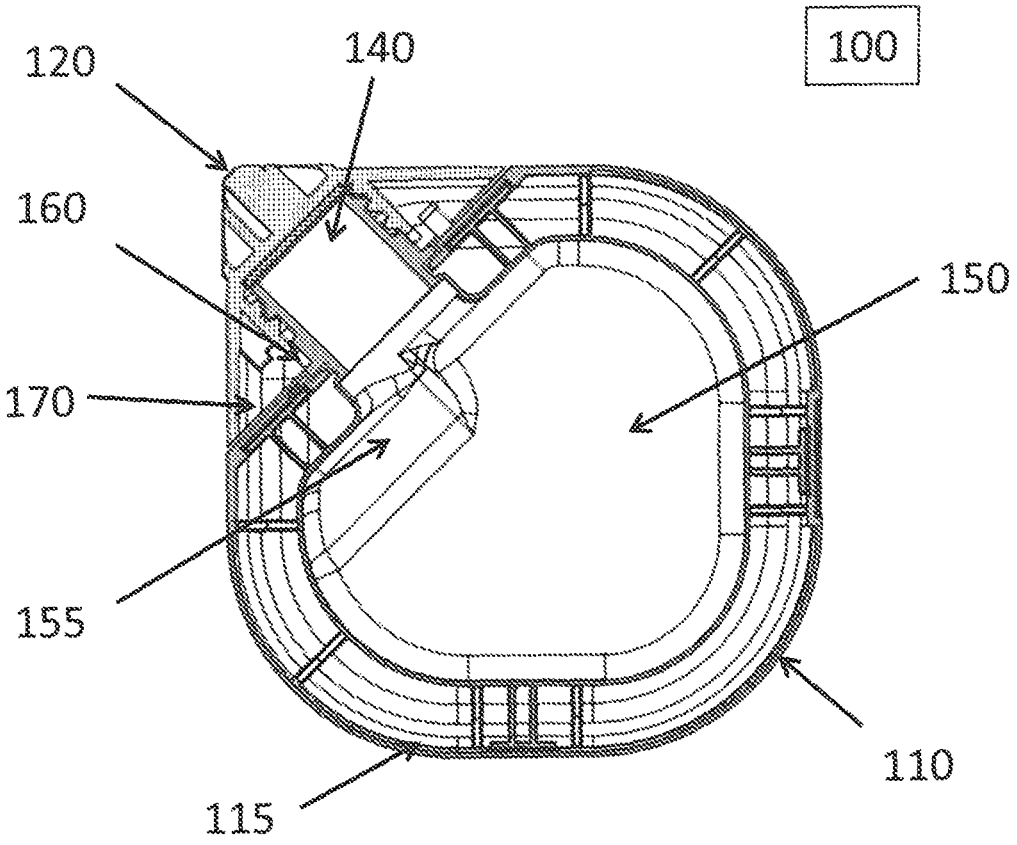

More details are shown in FIG. 1D, which is a cross-sectional view of pill container 100. As shown, bottle 150 has a size and shape similar to outer shell 110, fitting securely within the shell. Spout 140 protrudes through opening 160 of angled corner section 170 of the outer shell, and cap 120 seals spout 140. As can be seen, the pill container may rest on flat bottom section 115 to stand upright. In this specific embodiment, the container has an overall square cross-sectional shape (in the horizontal direction shown), with the outer shell of the container forming a truncated square and the triangular cap forming the rest of the square shape. Such a shape would be expected to fit comfortably within a user's palm.

As also shown in FIG. 1D, bottle 150 further comprising constriction 155. Parts of the walls of the bottle are tapered inwardly, forming a region within the bottle that has a reduced interior volume near the spout. As such, as the bottle is tipped to dispense pills, resistance is met within the restricted zone at the constriction, limiting the number of pills that exit the spout.

Figure 2A:
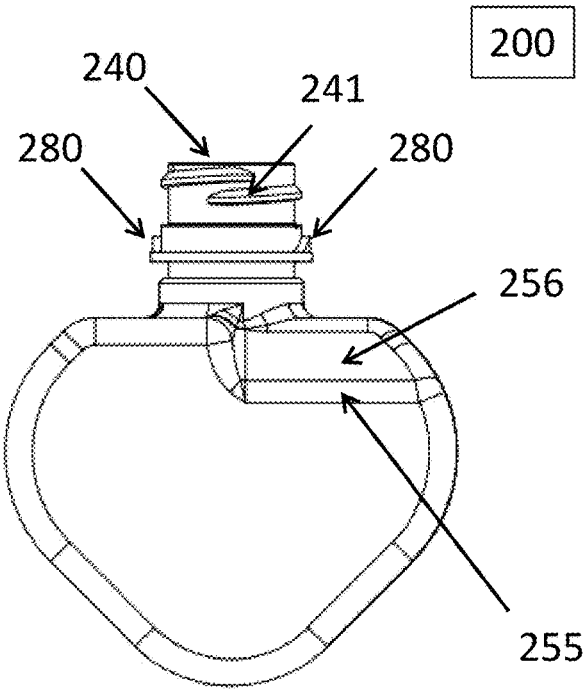
FIGS. 2A-2C are views of a bottle used in specific embodiments of the present disclosure.
Figure 2B:
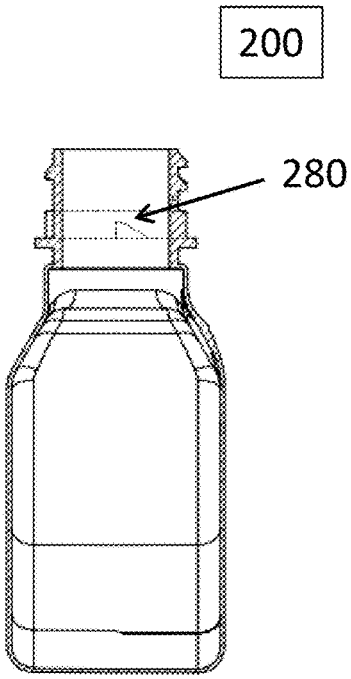
Figure 2C:
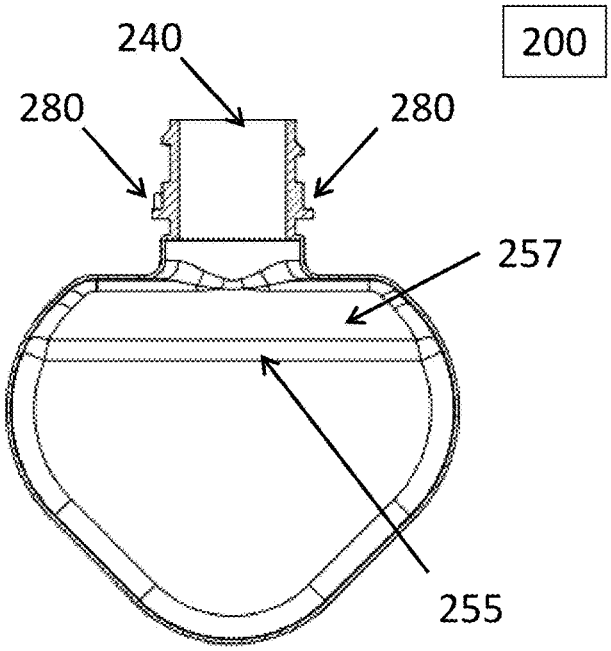

FIGS. 2A-2C are views of a bottle similar to that included in pill container 100 shown in FIG. 1D. A shown in FIG. 2A, which is a front perspective view of bottle 200, constriction 255 provides a zone of decreasing volume from the interior of the bottle to spout 240 and is formed by slanted interior wall 257, which spans substantially half the width of the bottle to the spout. As shown in FIG. 2C, which is a back cross-sectional view, additional constriction is provided by inwardly slanted wall 256, which, in this embodiment, spans the width of bottle 200. Thus, during use, pills stored within the main volume of the bottle, would pass to a partial region of reduced volume (formed only by slanted wall 256) and then enter a further reduced volume region (formed by both slanted walls 256 and 257), before exiting through spout 240.

Spout 240 of bottle 200 in this specific embodiment further comprises a locking feature to provide resistance to the cap opening. As shown, spout 240 is a threaded spout, having threads 241 that would correspond to threads of a cap, discussed below. The spout further comprises raised section, insert 280, which is shown most clearly in FIG. 2B, which is a side cross-sectional view. As shown in FIG. 2A and FIG. 2C, a pair of inserts are provided in this embodiment, positioned on opposing sides of spout 240. The insert has an upslope and plateau, which is configured to engage with a corresponding feature of the cap.

Figure 3A:
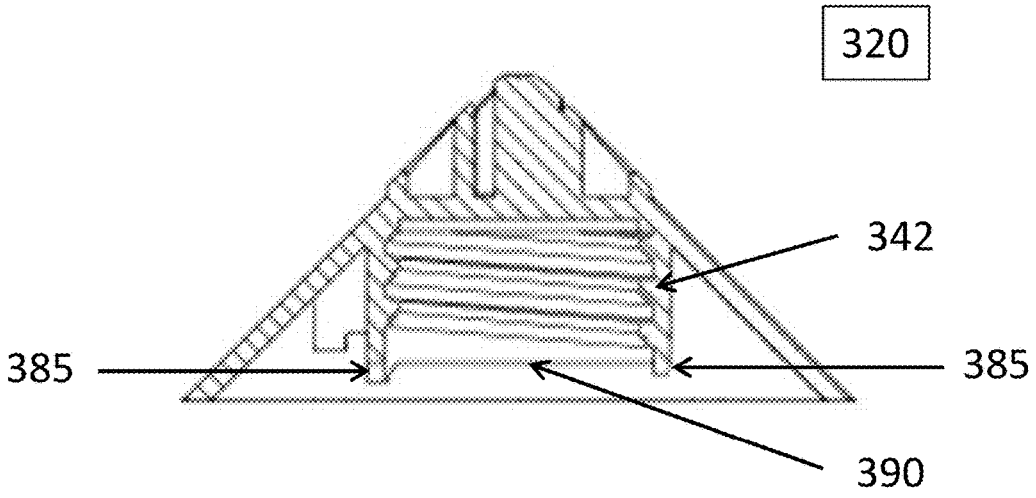
FIG. 3A-FIG. 3B are views of a cap used in specific embodiments of the present disclosure.
Figure 3B:
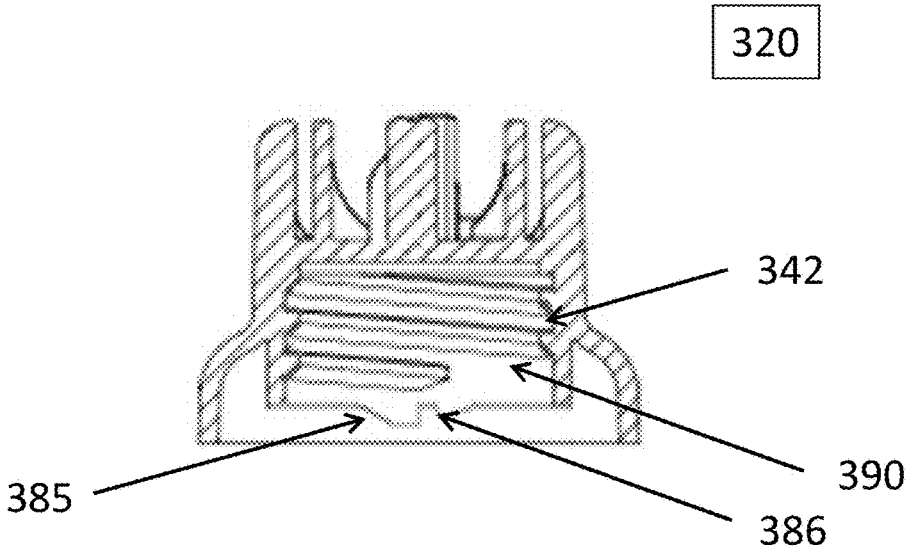

FIG. 3A and FIG. 3B are front and side cross-sectional views, respectively of cap 320, which can be used in specific embodiments of the present disclosure. Cap 320 has an overall triangular shape and comprises threads 342 within spout engagement section 390. The cap further comprises raised section 385 having notch 386. As shown in FIG. 3A, a pair of raised sections are provided on opposing sides of the spout engagement section. When cap 320 is turned to seal the container, raised section 385 is configured to pass over the upslope of insert 280 (shown in FIG. 2B) until the plateau region engages with notch 386. In this way, the insert of the spout rests inside the notch of the cap, which, due to the direction of the thread, additionally drives the insert in. Opening the container by counterturning the cap would require sufficient force and energy to disengage the insert from the notch, thereby providing resistance to opening and a more secure closure.

Figure 4B:
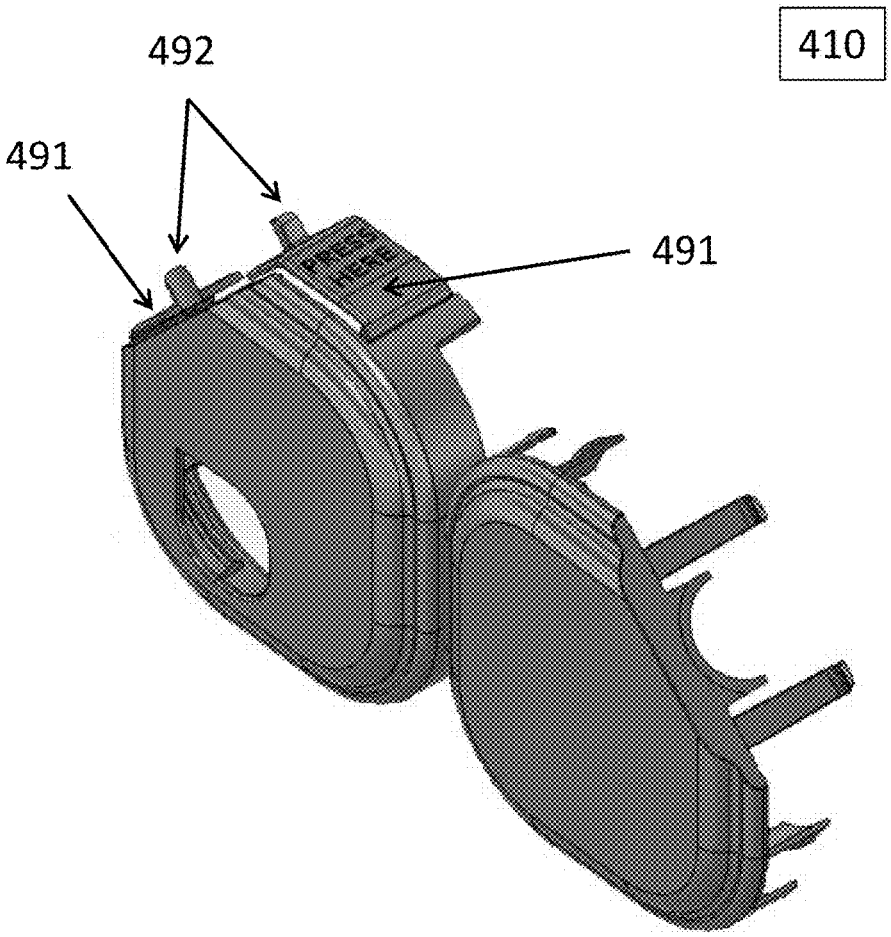
Figure 4C:
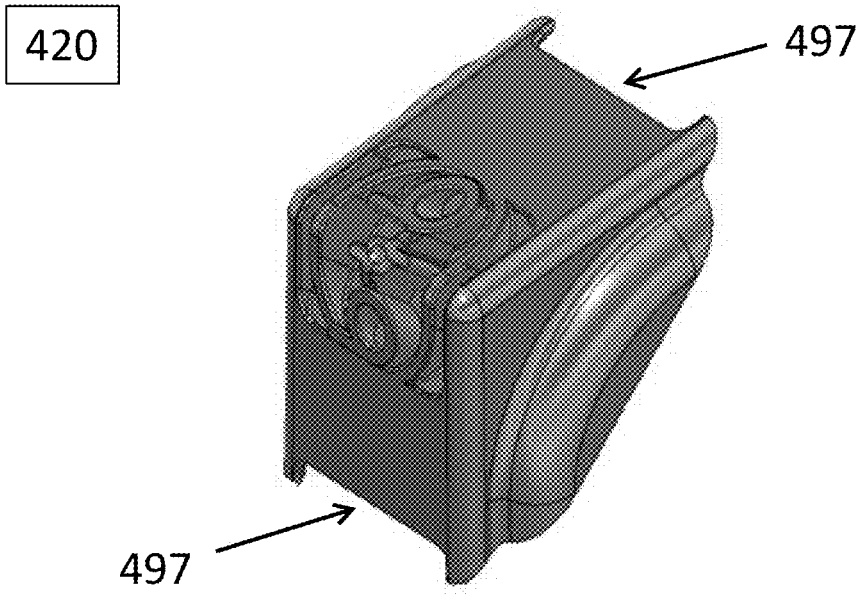
Figure 4D:
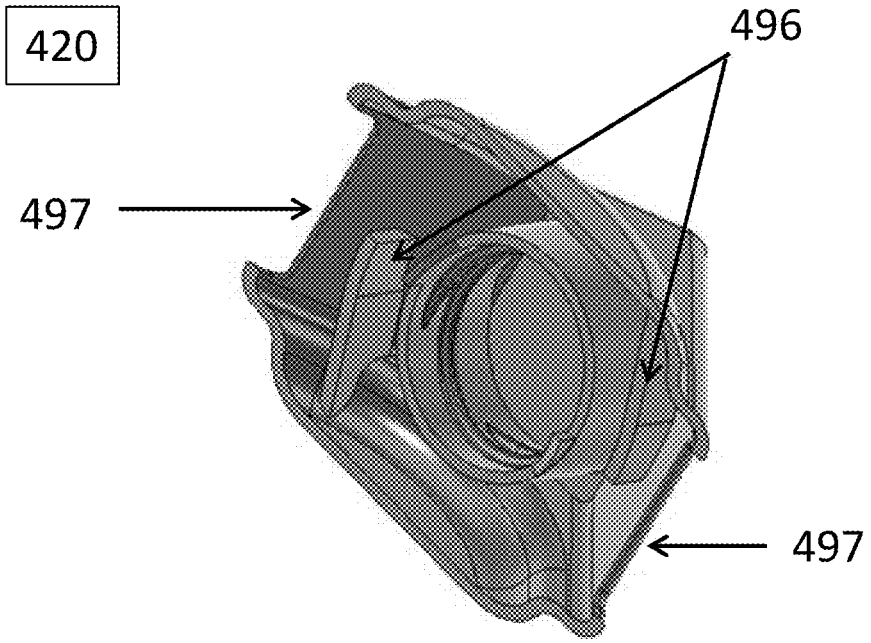

Another embodiment of the pill container of the present disclosure is shown FIGS. 4A-4D which are perspective views of pill container 400 (FIG. 4A), outer shell 410 of pill container 400 (FIG. 4B, shown open), and cap 420 (FIG. 4C, a top view, and FIG. 4D, a bottom view). As shown in FIG. 4A, pill container 400 comprises mated interlocks configured to prevent the cap from turning, making it more difficult, for example, for a child to open the container. In particular, outer shell 410 comprises locking tabs 491 which interact and engage with portions of cap 420. Although only one locking tab may be needed, in this embodiment, a pair of locking tabs is provided for additional security since both would need to be depressed in order for the cap to be able to be turned. In more detail, as shown in FIG. 4B, locking tabs 491 each comprise extenders 492 which interact with blocking tabs 496 provided under cap 420 (shown more clearly in FIG. 4C, and FIG. 4D). Again, a pair of blocking tabs is shown, corresponding with the pair of locking tabs, although additional or fewer of either may be used. Also included in this specific embodiment are gaps 497 in cap 420, which also engage with locking tabs 491 of outer shell 410. In this way, additional security is provided since, should the extender break or no longer engage the blocking tab of the cap, the cap would still not be readily able to be turned without first depressing the locking tabs since they sit with the gaps.

The foregoing description of preferred embodiments of the present disclosure has been presented for the purposes of illustration and description. It is not intended to be exhaustive or to limit the disclosure to the precise form disclosed. Modifications and variations are possible in light of the above teachings, or may be acquired from practice of the disclosure. For example, while the container herein is described primarily with respect to dispensing medication or pills, features herein may be adapted for use with dispensing other forms of consumables (e.g., mints, gum, etc.), as well. The embodiments were chosen and described in order to explain the underlying principles and their practical application to enable one skilled in the art to utilize the disclosure in various embodiments and with various modifications as are suited to the particular use contemplated. It is intended that the scope of the disclosure be defined by the claims appended hereto and their equivalents.

What is claimed is:

1. A pill container comprising an outer shell having a flat bottom section and an angled corner section, the angled corner section having an opening for dispensing pills, wherein the outer shell includes a first shell section and a second shell section that snap together to form the outer shell;

a bottle disposed within the outer shell, wherein the first shell section and the second shell section snap together around the bottle to enclose all but a spout of the bottle;

a constriction within the bottle configured to reduce flow of the pills out from the pill container, and a cap formed in substantially triangular shape, the cap configured to screw onto the bottle and seal the opening of the outer shell, wherein the cap includes a raised section having a notch, the notch configured to pass over and engage with a raised insert protruding from the bottle as the cap is turned.

2. The pill container of claim 1, wherein the bottle is sized and shaped to fit within the outer shell and configured to contain the pills.

3. The pill container of claim 2, wherein the bottle comprises a spout configured to protrude through the opening.

4. The pill container of claim 2, wherein the constriction comprises wall sections of the bottle adjacent to the spout inwardly slanted towards the spout.

5. The pill container of claim 2, wherein the constriction forms a zone of decreasing volume within the bottle towards the spout.

6. The pill container of claim 2, wherein the spout has threads and the cap comprises threads corresponding to the threads of the spout.

7. The pill container of claim 2, wherein the spout further comprises a raised insert.

8. The pill container of claim 2, wherein the bottle is transparent, and wherein the outer shell further comprises at least one window for viewing the pills of the transparent bottle.

9. The pill container of claim 1, wherein the flat bottom section is configured to enable the pill container to stand upright.

10. The pill container of claim 1, wherein the first shell section and the second shell section are hinged.

11. The pill container of claim 1, wherein the outer shell further comprises at least one transparent window for viewing the pills of the pill container.

12. The pill container of claim 1, wherein, in a direction perpendicular to the flat bottom section, the outer shell has a substantially square cross-sectional shape.

13. The pill container of claim 1, wherein the cap and the outer shell comprise mated interlocks configured to prevent the cap from turning.

14. The pill container of claim 13, wherein the mated interlocks include at least one raised blocking tab on the cap and at least one inwardly depressible locking tab on the outer shell.

15. The pill container of claim 14, wherein the inwardly depressible locking tab comprises an extender configured to engage the raised block on the cap to prevent the cap from turning.

16. The pill container of claim 14, wherein the cap further comprises a gap along an edge adjacent to the outer shell sized and shaped to allow engagement with the inwardly depressible locking tab to prevent the cap from turning.

17. The pill container of claim 14, wherein the outer shell comprises a pair of inwardly depressible locking tabs positioned on opposing sides of the opening and configured to mate with a corresponding pair of raised blocking tabs on the cap to prevent the cap from turning.

18. A pill container comprising means for storing and dispensing pills comprising an outer shell having a flat bottom section and an angled corner section, the angled corner section having an opening for dispensing the pills and a cap configured to seal the opening, wherein the outer shell includes a first shell section and a second shell section that snap together to form the outer shell, a bottle within the outer shell having a constriction configured to reduce flow of the pills out from the pill container, wherein the first shell section and the second shell section snap together around the bottle to enclose all but a spout of the bottle, and a cap formed in substantially triangular shape, the cap configured to screw onto the bottle and seal the opening of the outer shell, wherein the cap includes a raised section having a notch, the notch configured to pass over and engage with a raised insert protruding from the bottle as the cap is turned.

* * * * *